US005243923A

United States Patent [19]

Rendahl

[11] Patent Number: 5,243,923

[45] Date of Patent: Sep. 14, 1993

[54] ZIGZAG SETTER WITH SLIDER AND COAXIAL CONTROLS AND ADJUSTOR CAMS

[75] Inventor: Karl I. F. Rendahl, Huskvarna, Sweden

[73] Assignee: Husqvarna Sewing Machines Aktiebolag, Sweden

[21] Appl. No.: 902,712

[22] Filed: Jun. 23, 1992

[30] Foreign Application Priority Data

Aug. 9, 1991 [SE] Sweden ..... 9102324

[51] Int. Cl.[5] ..... D05B 3/02

[52] U.S. Cl. ..... 112/464; 112/465

[58] Field of Search ..... 112/220, 259, 284, 315, 112/448, 459, 460, 462–466, 449; 74/53, 60, 567, 569

[56] References Cited

U.S. PATENT DOCUMENTS

| | | | |
|---|---|---|---|
| 1,846,179 | 2/1932 | Biggert, Jr. | 74/53 |
| 2,879,732 | 3/1959 | Casas-Robert et al. | 112/460 |
| 2,924,120 | 2/1960 | Johnson | 112/460 X |
| 3,585,876 | 6/1971 | Marsh | 112/448 X |
| 3,643,612 | 2/1972 | Hanyu et al. | 112/448 |
| 3,754,521 | 8/1973 | Thuring | 112/448 X |
| 3,766,871 | 10/1973 | Mastuda et al. | 112/463 X |
| 4,313,389 | 2/1982 | Hanyu et al. | 112/463 |
| 4,448,141 | 5/1984 | Szostak et al. | 112/459 X |
| 4,530,298 | 7/1985 | Szostak et al. | 112/463 X |
| 4,577,575 | 3/1986 | Stevens et al. | 112/448 X |
| 4,893,575 | 1/1990 | Rendahl | 112/465 |

FOREIGN PATENT DOCUMENTS

| | | | |
|---|---|---|---|
| 0090593 | 6/1961 | Denmark | 112/448 |
| 1-070096 | 3/1989 | Japan | 112/463 |
| 0830502 | 3/1960 | United Kingdom | 112/448 |
| 0859981 | 1/1961 | United Kingdom | 112/448 |

*Primary Examiner*—Clifford D. Crowder
*Assistant Examiner*—Ismael Izaguirre
*Attorney, Agent, or Firm*—Pearne, Gordon, McCoy & Granger

[57] ABSTRACT

A mechanical, cam disk controlled zigzag sewing machine which provides an infinite zigzag adjustment device whereby a cam follower lifter restricts the zigzag width. The adjusting device returns to its initial position each time the cam follower lifter is actuated, i.e. when a new stitch pattern is selected. The adjustment device has the shape of a gradually rising cam profile and actuates a slide (31) which, by means of a finger (51), extends into the path of movement of the cam follower (48) in order to restrict the same with the result that the lateral movement of the needle is restricted in one direction.

1 Claim, 4 Drawing Sheets

ZIGZAG SETTER WITH SLIDER AND COAXIAL CONTROLS AND ADJUSTOR CAMS

BACKGROUND OF THE INVENTION

The present invention relates to a zigzag sewing machine for pattern stitching comprising a set of cam disks rotatable by the drive shaft of the machine, a cam follower (48) actuated by a resilient means and adjustable by means of a zigzag control means (20) in relation to the cam disk set to be connected to the cam disks thereof, and a lifting means actuated by the zigzag control means to lift the cam follower to an outer end position spaced from the cam disk set. Sewing machines of this kind are provided for domestic use for performing utility and decoration stitches.

It is previously known in mechanical pattern sewing machines having a cam set for controlling the needle and feeding movements that the lateral movement of the needle can be provided by means of a single rotating cam disk and that an appropriate amplitude of the oscillating movement can be set by an adjusting means. A machine having such features is disclosed in Swedish patent SE 8702192-9 see U.S. Pat. No. 4,893,575. A component in such machines is the so-called lifter which lifts the cam follower to a position outside the cam disk set in order to enable movement thereof when changing between various stitches.

SUMMARY OF THE INVENTION

In accordance with the present invention, a lifter is provided which restricts the zigzag width. Due to the fact that an existing component is used, adjusting means for the zigzag movement can be made as a very simple device of the machine.

The combination with the lifter provides for the return of the adjusting means to its initial position each time the lifter is actuated, i.e. when a new stitch pattern is selected. In comparison with what is previously known, the device according to the invention comprises few components and has a simple and clear control means and a greater optional variety for the selection of stitch patterns. This has been obtained by means of a sewing machine of the aforementioned type which, according to the invention, is generally characterized by an infinitely variable adjusting means which, via the lifting means and against the action of said resilient means, adjusts the cam follower to an arbitrarily selected position between the outer end position and an inner end position in engagement with the cam disk set in order to optionally restrict the stitch width. The adjusting means is adapted to return automatically to its initial position when a new stitch pattern is selected.

BRIEF DESCRIPTION OF THE DRAWINGS

An embodiment of a sewing machine having a zigzag control according to the invention is described in the following with reference to the accompanying drawings, in which.

DETAILED DESCRIPTION OF THE PREFERRED EMBODIMENT

Figure 1:
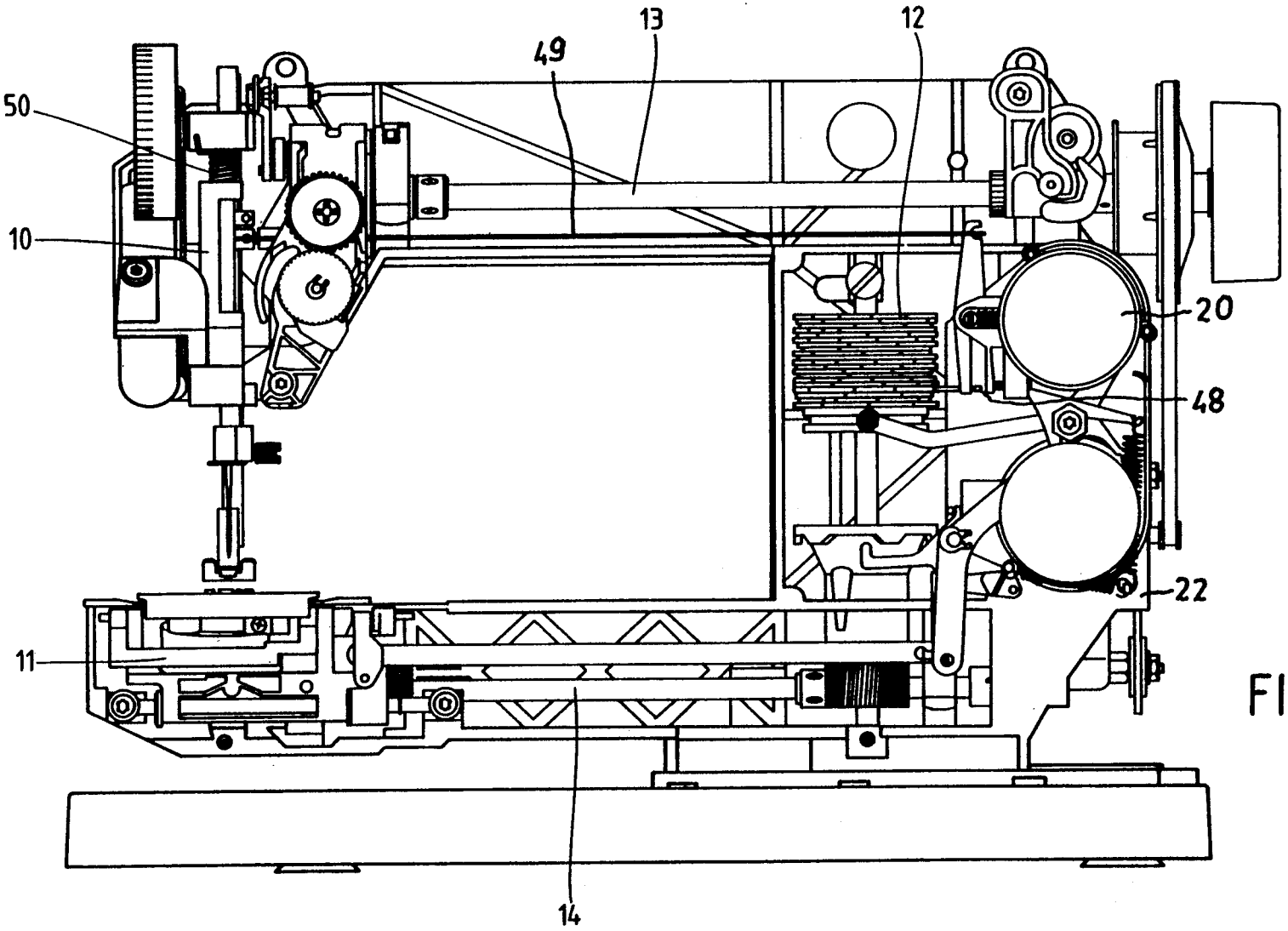
FIG. 1 is a front elevation of the sewing machine with the front cover thereof removed.

The illustrated sewing machine is of the mechanic, cam-controlled design comprising a presser bar and needle bar unit 10, shuttle and feeding unit 11, zigzag control 12, and upper and lower drive shafts 13, 14.

The adjustment of the zigzag control for the selection of various stitches is performed by a control knob 20 which is journalled on a pivot 21 of the machine body 22 by means of a tube shaft 23. The inner end of the tube shaft 23 supports a sun-gear 24 of a planetary gearing having an outer gear ring 25 and a planet gear 26 mounted on a hub portion 27 of the tube shaft. When the control knob 20 rotates, the hub portion 27 rotates therewith in the same direction but at an essentially reduced speed due to the transmission ratio of the rotational movement provided by the planetary gearing. Less power is therefore required of the operator to rotate the knob 20 than if no gearing had been provided. The rotation is performed in steps of about 90° which are determined by a cam disk 28 connected to the tube shaft 23, and a projection 30 attached to a slide 31. The disk 28 has four recesses 32 and the slide 31 has an elongated hole 33 surrounding the tube shaft 23 and a slot 34 in an extension 35 whereby the slide is movable in a horizontal direction. The movement is provided by the cam disk 28 when rotated by forcing the projection 30 out of one of the recesses 32 whereby the slide 31 is moved to the left in FIG. 2 against the action of a compression spring 36. The spring engages one end of the slot 34 and a pin 37 in the body, respectively, and actuates the slide 31 to return to the shown position when a new recess 32 opens to the projection 30 when the cam disk 28 has been rotated 90°.

A further possibility of moving the slide 31 is provided by an additional cam disk 38 with a knob 39 on the tube shaft 23 inside the control knob 20. The disk 38 has a gradually rising cam 40 interacting with a cam follower 41 of the slide 31 which is thereby moved to the left when the knob 39 is rotated clockwise. The cam disk 38 has a return spring 42 attached at 43, 44 to the body and the periphery of the disk 38, respectively. When the disk 38 is set at a certain angle the cam 40 follower 41 frictionally engages the cam whereby the disk is held in the adjusted position. However, as soon as the knob 20 is rotated the setting is relieved whereby the slide 31 and the cam follower 41 are moved to the left to disengage the cam disk 38 so that the spring 42 can return the disk to its initial position (shown) in which a finger 45 of the disk engages a stop 46. When the projection 30 has again entered a recess 32, a new adjustment can be made by the knob 39 which is then maintained in its position due to the mentioned frictional engagement.

The mentioned pin 37 also provides a pivot for a lever 47 which forms a connection between an additional lever 48 and a tension rod 49. These members transmit adjusting movements from the cam disk set of the zigzag mechanism to the needle bar unit 10. In one direction the adjustment takes place by a forced movement by the cam disk and in the other direction by a resilient action by a torsion spring 50. In the direction of the forced movement the needle always makes a full turn in accordance with the profile of the cam disk. In the opposite direction in which the movement is provided by resilient means the movement can be actuated by control means appearing in the path of the lever. One such control means is formed by a finger 51 provided on the extension 35 of the slide 31.

As mentioned in the introduction, the so-called lifter has the function of lifting the cam follower from the cam disk set when the stitch pattern is changed. In the present embodiment the lifter is formed by the finger 51 and the lever 48 constitutes the cam follower. When the knob 20 is rotated, the slide 31 and the finger 51 are moved to the left (FIG. 2) and the latter engages the end of the lever 48 and rotates the lever so that the opposite end thereof is released from the cam disk set. A set screw 52 in a projection 53 of the slide 31 provides a stop position for the finger 51 in the right hand direction.

Figure 2:
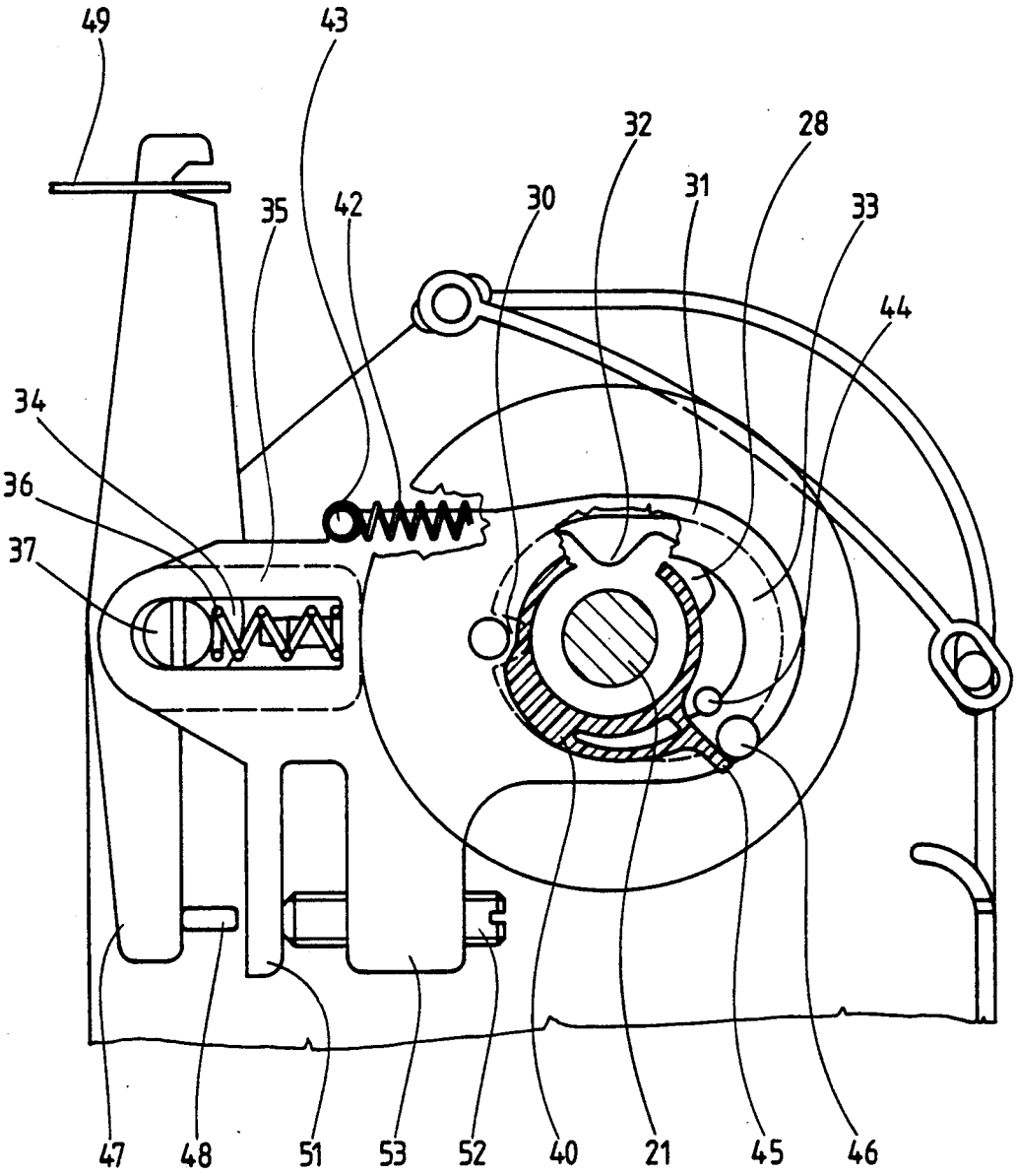
FIG. 2 is a detail view of a zigzag control in front elevation.
Figure 3:
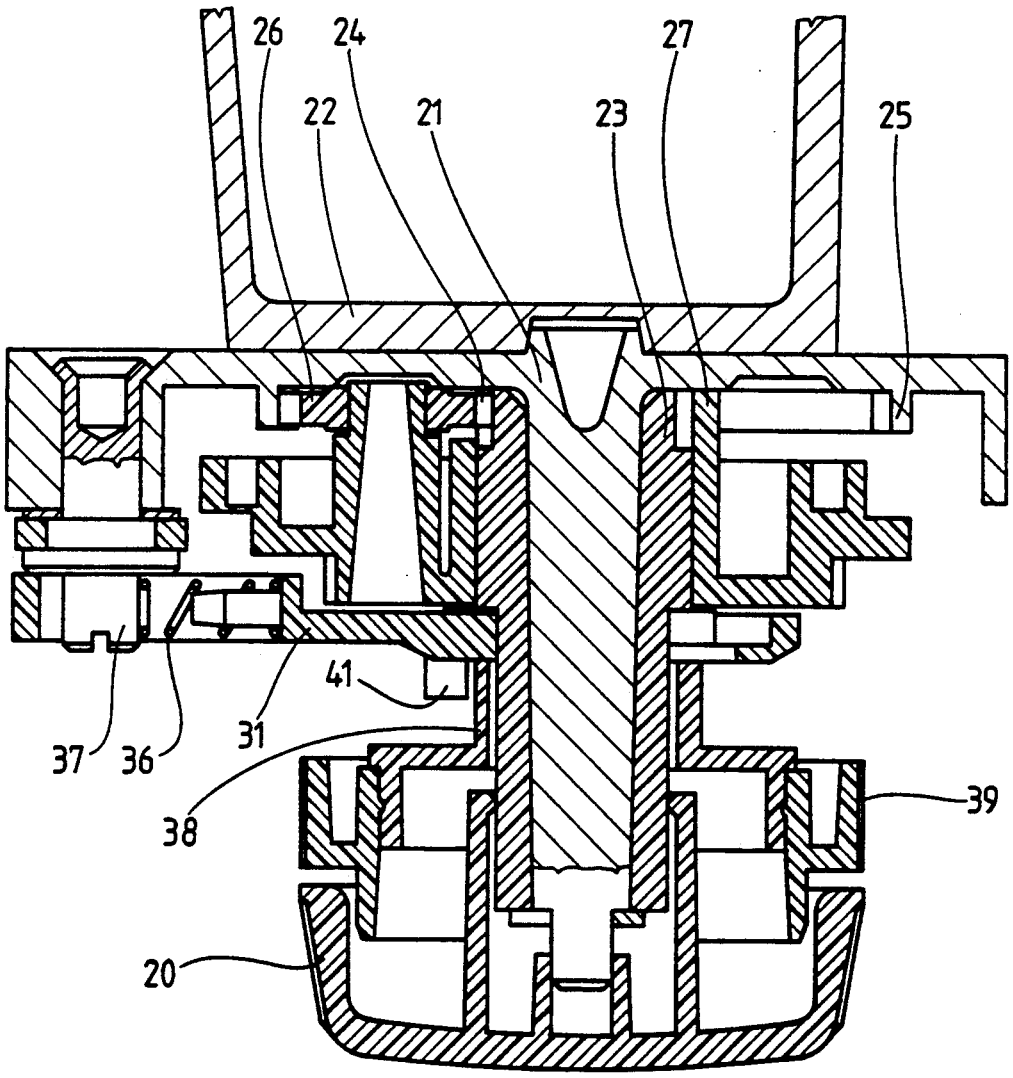
FIG. 3 is a horizontal sectional view of the zigzag control.
Figure 4:
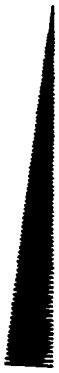
FIG. 4 is an example of a seam illustrating the stitch width control.

The function of the above described control knob 39 is such that the finger 51 is moved to the left in FIG. 2 even when this knob is adjusted. The position of the finger relative to the cam follower is controlled by the cam disk 38 and the lateral movements of the needle bar are partly restricted whereby the stitch field at the needle plate is restricted starting from the left end position. When a maximum adjustment of the knob has been made, the machine performes a straight seam at the right end position, but with a gradually decreasing adjustment a zigzag seam is provided (from zigzag cam disk) with increasing width from zero to maximum (FIG. 4). The straight seam is the result of the cam follower being moved to its left end position by the cam disk 38, and in this position the zigzag cam disk of the cam disk set has no influence on the lateral position of the needle. As the adjustment of the cam disk 38 is reduced, the zigzag cam disk takes over more and more of the lateral movement of the needle and will control these movements completely when the cam disk 38 is disengaged. This provides the angularly shaped seam illustrated in FIG. 4.

Figure 5A:
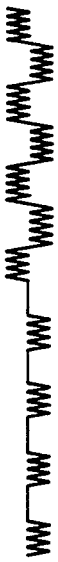
FIGS. 5*a*, 5*b*, and 5*c* illustrate stitches formed before and after the restriction of the zigzag stitch width, respectively.
Figure 5B:
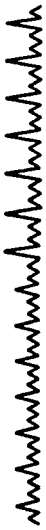
Figure 5C:
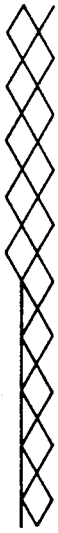

The control knob 39 provides the possibility of selecting the zigzag width of several seams with the possibility of obtaining new decoration stitches. In FIGS. 5*a*, 5*b* and 5*c*, the top portions of the shown seams are provided at full zigzag width and the bottom portions are obtained by restriction of the zigzag width by means of the control knob 39. By the width reduction some of the seams obtain an appearance quite different from the original, and others are only a smaller variant of the same seam.

I claim:

1. A zigzag sewing machine for pattern stitching, comprising:

a set of cam disks, said set of cam disks being rotatable by a sewing machine drive shaft;

a cam follower for following a cam surface of each of said cam disks;

resilient actuating means for actuating said cam follower;

zigzag control means for adjusting said cam follower relative to the set of cam disks by engaging the cam surfaces of said disks;

lifting means for lifting the cam follower to an outer end position spaced from the set of cam disks, said lifting means being actuated by the zigzag control means;

adjusting means for adjusting the cam follower to an arbitrarily selected position between the outer end position and an inner end position against the action of the resilient actuating means such that said cam follower is in engagement with the set of cam disks to restrict a stitch width, said adjusting means being adapted to automatically return to the inner end position when a new stitch pattern is selected, wherein said lifting means includes a slide which displaces the cam follower a distance from the inner end position to provide a one-sided restriction of the stitch width, said slide being separately actuatable by the zigzag control means and the adjusting means, said zigzag control means and said adjusting means being rotatably journalled on a common shaft.

* * * * *